US008439710B2

(12) United States Patent
Szczesny

(10) Patent No.: US 8,439,710 B2
(45) Date of Patent: May 14, 2013

(54) ELECTRICAL CONNECTOR HAVING BIASING MEMBER

(75) Inventor: David S. Szczesny, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/155,052

(22) Filed: Jun. 7, 2011

(65) Prior Publication Data

US 2012/0315799 A1 Dec. 13, 2012

(51) Int. Cl.
*H01R 24/00* (2006.01)

(52) U.S. Cl.
USPC ..... 439/676

(58) Field of Classification Search ..... 439/676, 439/660, 79
See application file for complete search history.

(56) References Cited

U.S. PATENT DOCUMENTS

| | | | | |
|---|---|---|---|---|
| 3,336,564 | A * | 8/1967 | McCaughey | 439/391 |
| 4,867,700 | A * | 9/1989 | Kreinberg | 439/422 |
| 4,975,081 | A * | 12/1990 | Daly et al. | 439/498 |
| 5,096,435 | A * | 3/1992 | Noschese et al. | 439/260 |
| 5,211,571 | A * | 5/1993 | Arai et al. | 439/325 |
| 5,647,755 | A * | 7/1997 | Hida et al. | 439/328 |
| 5,997,356 | A | 12/1999 | Chang | |
| 6,227,898 | B1 * | 5/2001 | Meng et al. | 439/377 |
| 6,722,915 | B1 | 4/2004 | McAlonis et al. | |
| 6,848,943 | B2 * | 2/2005 | Machado et al. | 439/607.01 |
| 6,881,096 | B2 * | 4/2005 | Brown et al. | 439/620.01 |
| 7,018,242 | B2 * | 3/2006 | Brown et al. | 439/676 |
| 7,044,777 | B1 | 5/2006 | Daly et al. | |
| 7,686,656 | B2 * | 3/2010 | Zheng et al. | 439/660 |
| 7,699,644 | B2 * | 4/2010 | Szczesny et al. | 439/377 |
| 7,841,872 | B2 * | 11/2010 | Zhang et al. | 439/79 |
| 7,841,905 | B2 * | 11/2010 | Zheng et al. | 439/660 |
| 8,062,073 | B1 * | 11/2011 | Szczesny et al. | 439/660 |
| 8,142,206 | B2 * | 3/2012 | Zhang et al. | 439/79 |
| 2007/0173127 | A1 * | 7/2007 | Regnier et al. | 439/637 |
| 2010/0015855 | A1 * | 1/2010 | Chiang | 439/660 |
| 2010/0233910 | A1 * | 9/2010 | Zhang et al. | 439/626 |
| 2011/0070779 | A1 * | 3/2011 | Zhang et al. | 439/660 |

OTHER PUBLICATIONS

International Search Report, International Application No. PCT/US2012/040828, International Filing Date May 6, 2012.

* cited by examiner

*Primary Examiner* — Amy Cohen Johnson
*Assistant Examiner* — Vladimir Imas

(57) ABSTRACT

An electrical connector includes a housing having a top and a bottom. An upper connector portion is formed at the top of the housing. The upper connector portion has upper contacts. A lower connector portion is formed at the bottom of the housing. The lower connector portion has lower contacts. A card slot is formed between the upper connector portion and the lower connector portion. The card slot is configured to receive a substrate having upper plug contacts and lower contacts. The upper contacts of the upper connector portion are configured to engage the upper plug contacts of the substrate. The lower contacts of the lower connector portion configured to engage the lower contacts of the substrate. A biasing member is coupled to the lower connector portion. The biasing member is configured to bias the substrate toward the upper connector portion to align the upper plug contacts of the substrate with the upper contacts of the upper connector portion.

17 Claims, 8 Drawing Sheets

ELECTRICAL CONNECTOR HAVING BIASING MEMBER

BACKGROUND OF THE INVENTION

The subject matter described herein relates generally to electrical connectors, and more particularly, to electrical connectors having a biasing member.

Electrical assemblies generally include a substrate having connectors coupled thereto. The connectors electrically join electrical components and peripheral devices to the electrical assembly. Often the connectors are configured to receive transceivers or the like. The transceivers include a substrate having high speed and low speed contacts. The connector generally includes high speed contacts configured to receive the high speed contacts of the transceiver and low speed contacts configured to receive the low speed contacts of the transceiver. The connector electrically couples the transceiver to the electrical assembly.

However, conventional connectors are not without their disadvantages. When the transceiver is coupled to the connector a vertical alignment of the transceiver must be maintained to ensure a proper connection between the contacts of the connector and the contacts of the transceiver. However, the transceiver often includes a heat sink coupled thereto. The heat sink creates a downward force on the transceiver as the transceiver is joined to the connector. Such downward force may create a misalignment between the high speed contacts of the connector and the high speed contacts of the transceiver substrate. As such, the high speed contacts may be improperly engaged. Improper engagement of the high speed contacts may reduce an efficiency of the transceiver and/or prohibit signals from being transmitted between the connector and the transceiver.

A need remains for a connector that provides vertical alignment of the connector contacts and the transceiver contacts.

SUMMARY OF THE INVENTION

In one embodiment, an electrical connector is provided. The connector includes a housing having a top portion and a bottom portion. An upper connector portion is formed at the top of the housing. The upper connector portion has upper contacts. A lower connector portion is formed at the bottom of the housing. The lower connector portion has lower contacts. A card slot is formed between the upper connector portion and the lower connector portion. The card slot is configured to receive a substrate having upper plug contacts and lower contact pads. The upper contacts of the upper connector portion are configured to engage the upper plug contacts of the substrate. The lower contacts of the lower connector portion configured to engage the lower contact pads of the substrate. A biasing member is coupled to the lower connector portion. The biasing member is configured to bias the substrate toward the upper connector portion to align the upper plug contacts of the substrate with the upper contacts of the upper connector portion.

In another embodiment, an electrical connector is provided. The connector includes a housing having a first connector and a second connector positioned proximate to the first connector. The first connector is configured to receive first contacts of a substrate and the second connector is configured to receive second contacts of the substrate. A card slot is formed between the first connector and the second connector. The card slot is configured to receive the substrate. A biasing member is coupled to the second connector and configured to bias the substrate toward the first connector to align the first contacts of the substrate with the first connector.

In another embodiment, an electrical assembly is provided. The assembly includes a transceiver having a substrate positioned therein. The substrate has upper plug contacts and lower contact pads. An electrical connector couples to the transceiver. The electrical connector includes an upper connector portion having upper contacts that engage the upper plug contacts of the substrate. A lower connector portion is coupled to the lower contact pad portion. The lower connector portion has lower contact pads that engage the lower contacts of the substrate. A card slot is formed between the upper connector portion and the lower connector portion. The card slot receives the substrate of the transceiver. A biasing member is coupled to the lower connector portion. The biasing member biases the substrate of the transceiver toward the upper connector portion to align the upper plug contacts of the substrate with the upper contacts of the upper connector portion.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
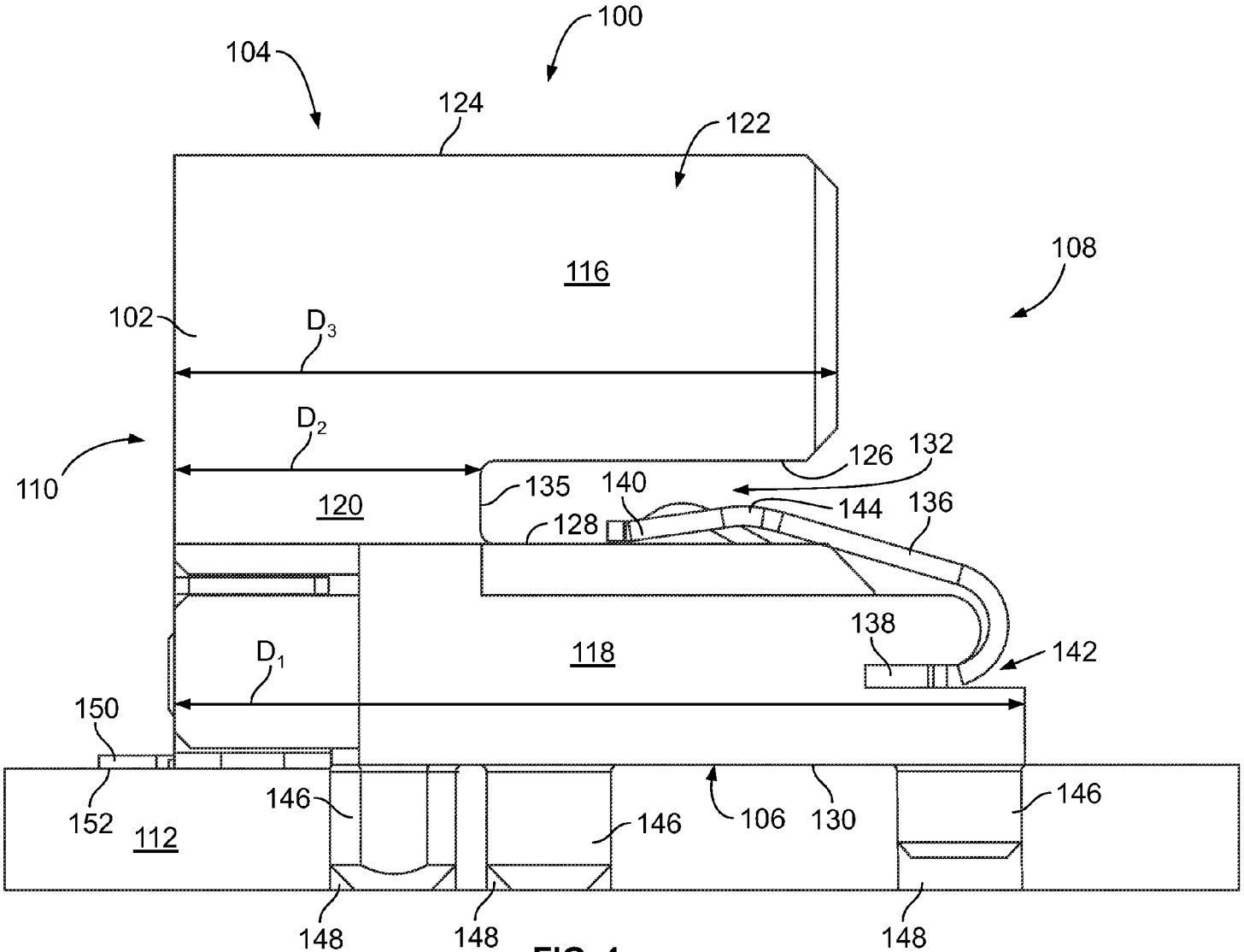
FIG. 1 is a side view of an electrical connector formed in accordance with an embodiment.

FIG. 1 is a side view of an electrical connector 100 formed in accordance with an embodiment. The electrical connector 100 includes a housing 102 having a top 104 and a bottom 106. A front 108 and a back 110 of the housing 102 extend between the top 104 and the bottom 106. The electrical connector 100 is mounted to a substrate 112. The substrate 112 may be a printed circuit board, for example, a motherboard, daughter card, backplane, midplane, or the like. The electrical connector 100 is electrically coupled to the substrate 112. Electrical signals, for example, power signals and/or data signals are directed between the electrical connector 100 and the substrate 112. The electrical connector 100 is configured to receive an electrical component 114 (shown in FIG. 4). The electrical component 114 is configured to couple to the front 108 of the electrical connector 100. The electrical connector 100 directs electrical signals between the electrical component 114 and the substrate 112.

The electrical connector 100 includes an upper connector portion 116 formed at the top 104 of the housing 102. A lower connector portion 118 is formed at the bottom 106 of the housing 102. The upper connector portion 116 is positioned adjacent to the lower connector portion 118. The upper connector portion 116 is coupled to the lower connector portion 118. Each of the upper connector portion 116 and the lower connector portion 118 extends from the back 110 of the electrical connector 100 toward the front 108 of the electrical connector 100. The lower connector portion 118 extends a distance $D_1$ from the back 110 of the electrical connector 100 to the front 108 of the electrical connector 100. The upper connector portion 116 includes a base 120 and a flange 122. The base 120 is coupled to the lower connector portion 118. The base 120 extends a distance $D_2$ from the back 110 of the electrical connector 100 to the front 108 of the electrical connector 100. The distance $D_2$ is less than the distance $D_1$. The flange 122 extends from the base 120 toward the front of the electrical connector 100. The flange 122 extends a distance $D_3$ from the back 110 of the electrical connector 100 to the front 108 of the electrical connector 100. The distance $D_3$ is greater than the distance $D_2$. The distance $D_3$ is less than the distance $D_1$.

The flange 122 of the upper connector portion 116 includes a top surface 124 and a bottom surface 126. The top surface 124 forms a top surface of the housing 102. The lower connector portion 118 includes a top surface 128 and a bottom surface 130. The bottom surface 130 forms a bottom surface of the housing 102. A card slot 132 is defined between the top surface 128 of the lower connector portion 118 and the bottom surface 126 of the flange 122 of the upper connector portion 116. The base 120 of the upper connector portion 116 forms a back wall 135 of the card slot 132. The card slot 132 is configured to receive a substrate 134 (shown in FIG. 4) of the electrical component 114.

A biasing member 136 is coupled to the lower connector portion 118. The biasing member 136 includes a mounting end 138 and a biasing end 140. The lower connector portion 118 includes a slot 142 that receives the mounting end 138 of the biasing member 136 to secure the biasing member 136 to the lower connector portion 118. The biasing end 140 of the biasing member 136 extends along a portion of the top surface 128 of the lower connector portion 118. The biasing member 136 includes a bend 144 formed therein. The bend 144 extends upward from the lower connector portion 118. The bend 144 extends toward the upper connector portion 116. The biasing member 136 extends from the lower connector portion 118 toward the upper connector portion 116. The biasing member 136 extends toward the bottom surface 126 of the flange 122 of the upper connector portion 116.

The lower connector portion 118 includes pins 146 extending therefrom. The pins 146 extend from the bottom surface 130 of the lower connector portion 118. The pins 146 are secured within apertures 148 formed in the substrate 112 to secure the electrical connector 100 to the substrate 112. The pins 146 may be retained within the apertures 148 through an interference fit. In one embodiment, the pins are deformable to create the interference fit with the apertures 148. In another embodiment, the apertures 148 are deformable to create the interference fit with the pins 146. Optionally, both the pins 146 and the apertures 148 may be deformable. The electrical connector 100 may be secured to the substrate 112 using any other suitable means in alternative embodiments.

A solder tail 150 extends from the electrical connector 100. The solder tail 150 extends from the back 110 of the electrical connector 100. The solder tail 150 extends from the lower connector portion 118. The solder tail 150 has a bottom surface 152 that is flush with the bottom surface 130 of the lower connector portion 118. The bottom surface 152 of the solder tail 150 abuts the substrate 112. The solder tail 150 is secured to the substrate 112. The solder tail 150 electrically couples the electrical connector 100 to the substrate 112. The solder tail 150 directs electrical signals between the electrical connector 100 and the substrate 112. In one embodiment, the electrical connector 100 may include any number of solder tails 150.

Figure 2:
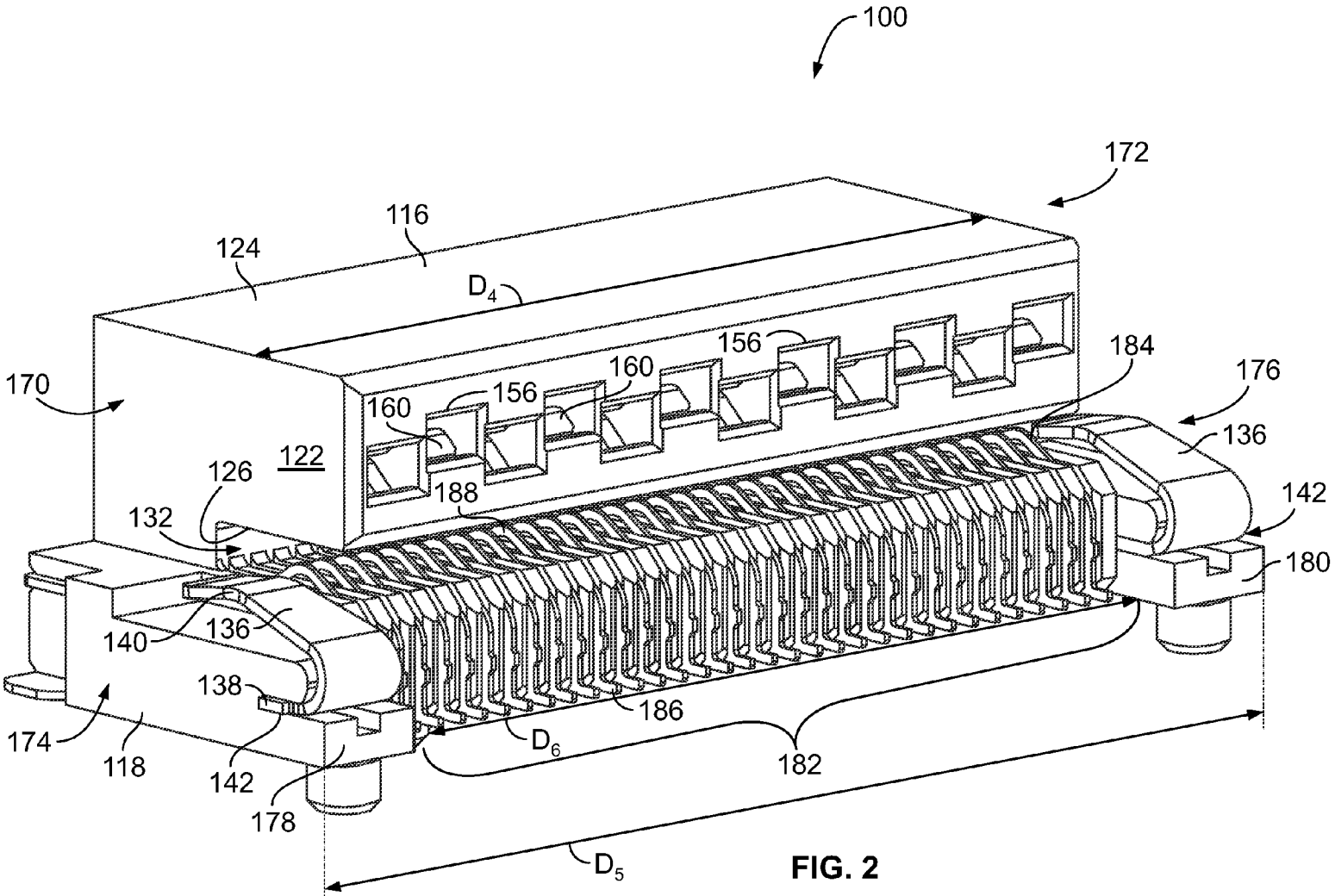
FIG. 2 is a front perspective view of the electrical connector shown in FIG. 1.

FIG. 2 is a front perspective view of the electrical connector 100. The upper connector portion 116 includes a first side 170 and a second side 172. The upper connector portion 116 extends a distance $D_4$ between the first side 170 and the second side 172. The lower connector portion 118 includes a first side 174 and a second side 176. The lower connector portion 118 extends a distance $D_5$ between the first side 174 and the second side 176. The distance $D_5$ is greater than the distance $D_4$. Alternatively, the distance $D_5$ may be the same or less than the distance $D_4$. The upper connector portion 116 is centered with respect to the lower connector portion 118. In other embodiments, the upper connector portion 116 may be offset with respect to the lower connector portion 118.

Figure 4:
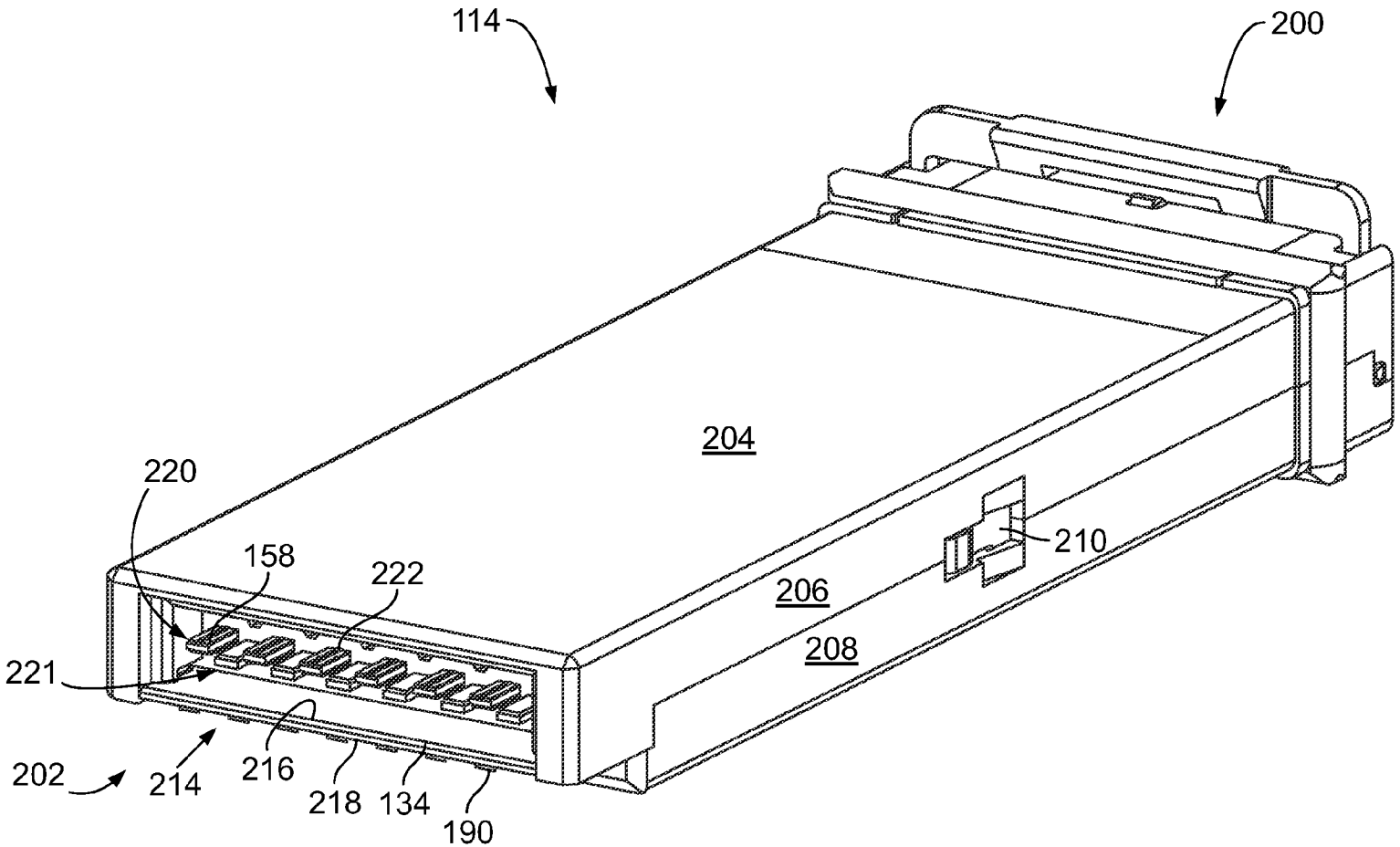
FIG. 4 is a top perspective view of an electrical component formed in accordance with an embodiment.

The flange 122 of the upper connector portion 116 includes receptacles 156 that are configured to receive plugs 158 (shown in FIG. 4) extending from the substrate 134 (shown in FIG. 4) of the electrical component 114 (shown in FIG. 4). In the illustrated embodiment, the receptacles 156 are offset from one another with respect to the top surface 124 and the bottom surface 126 of the upper connector portion 116 to facilitate proper connections with the electrical component 114. Optionally, the receptacles 156 may be aligned with one another. The receptacles 156 extend in a row between first side 170 and the second side 172 of the upper connector portion 116. The receptacles 156 include upper contacts 160 positioned therein. In an exemplary embodiment, the upper contacts 160 are configured to transmit and receive high speed signals to and from the electrical component 114. Alternatively, the upper contacts 160 may receive and transmit any electrical signals from the electrical component 114. In one embodiment, the upper contacts 160 are electrically coupled to the solder tail 150 (shown in FIG. 1). The solder tail delivers electrical signals between the upper contacts 160 and the substrate 112 (shown in FIG. 1).

The lower connector portion 118 includes a first end portion 178 positioned at the first end 174 of the lower connector portion 118 and a second end portion 180 positioned at the second end 176 of the lower connector portion 118. A contact portion 182 extends between the first end portion 178 and the second end portion 180. The contact portion 182 is positioned below and aligned with the flange 122 of the upper connector portion 116. The contact portion 182 extends a distance $D_6$ between the first end portion 178 and the second end portion 180. The distance $D_6$ is equal or about equal to the distance $D_4$ between the first side 170 and the second side 172 of the upper connector 116. In other embodiments, the distance D6 may be longer or shorter than D4.

The contact portion 182 of the lower connector portion 118 includes lower contacts 184. The lower contacts 184 extend in a row along the contact portion 182 between the first end portion 178 and the second end portion 180. The lower contacts 184 include a terminating end 186 and a mating end 188.

The terminating end 186 of each lower contact 184 is positioned proximate to the bottom surface 130 of the lower connector portion 118. The mating end 188 of each lower contact 184 extends from the top surface 128 of the lower connector portion 118. The mating end 188 of each lower contact 184 extends into the card slot 132. The mating end 188 of each lower contact 184 extends toward the bottom surface 126 of the flange 122 of the upper connector portion 116.

The mating end 188 of each lower contact 184 is configured to couple to a lower contact pad 190 (shown in FIG. 4) positioned on the substrate 134 of the electrical component 114. In one embodiment, the lower contacts 184 direct low speed signals between the electrical component 114 and the substrate 112. In one embodiment, the lower contacts 184 are DC contacts. When the mating ends 188 of the lower contacts 184 are engaged by the substrate 134 of the electrical component 114, the lower contacts 184 are forced downward so that the terminating ends 186 of the lower contacts engage the substrate 112. The lower contacts 184 electrically couple the electrical component 114 to the substrate 112.

Biasing members 136 are coupled to each of the first end portion 178 and the second end portion 180 of the lower connector portion 118. The slots 142 of the lower connector portion 118 are formed in each of the first end portion 178 and the second end portion 180 of the lower connector portion 118. The slots 142 receive the mounting ends 138 of the biasing members 136. The biasing ends 140 of the biasing members 136 extend over the first end portion 178 and the second end portion 180 along the top surface 128 of the lower connector portion 118. The biasing ends 140 of the biasing members 136 extend from the lower connector portion 118 toward the upper connector portion 116.

Figure 3:
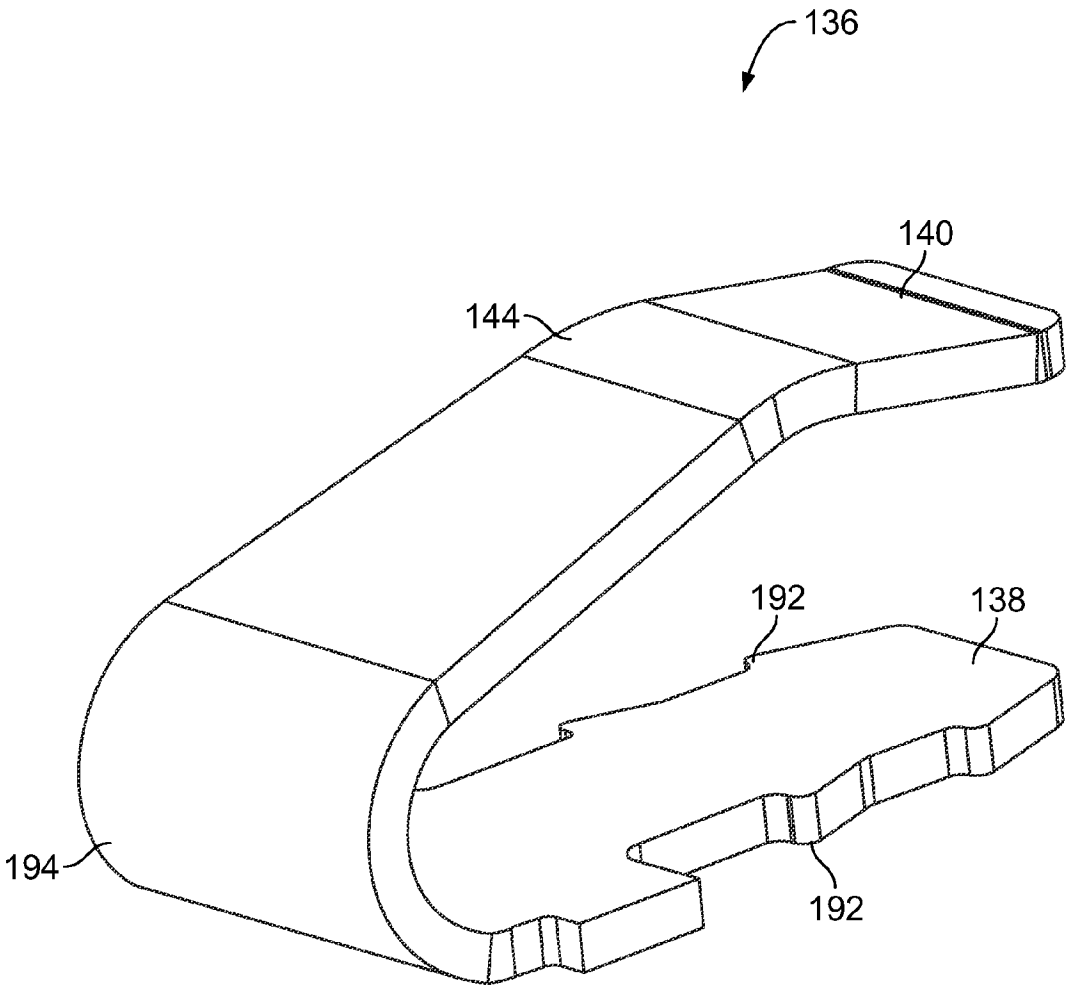
FIG. 3 is a front perspective view of a biasing member formed in accordance with an embodiment.

FIG. 3 is a front perspective view of a biasing member 136 formed in accordance with an embodiment. The biasing member 136 includes the mounting end 138 and the biasing end 140. The mounting end 138 includes barbs 192. The barbs 192 are configured to secure the biasing member 136 in the slot 142 (shown in FIGS. 1 and 2) of the lower connector portion 118 (shown in FIGS. 1 and 2). Alternatively, the mounting end 138 may include other coupling mechanisms to secure the biasing member 136 to the lower connector portion 118. In one embodiment, the slot 142 of the lower connector portion 118 deforms to receive the mounting end 138 of the biasing member 136. In other embodiments, the barbs 192 of the biasing member 136 may displace a portion of material from the slot 142 to secure the biasing member 136 to the lower connector portion 118.

An intermediate member 194 extends between the mounting end 138 and the biasing end 140 of the biasing member 136. The intermediate member 194 is curved. In one embodiment, the intermediate member 194 is curved approximately 180 degrees. Alternatively, the intermediate member 194 may be curved more or less than 180 degrees. The intermediate member 194 gives the biasing member 136 a substantially C-shaped configuration. The intermediate member 194 positions the biasing end 140 above the mounting end 138.

The intermediate member 194 is flexible to enable the biasing end 140 to move with respect to the mounting end 138. The intermediate member 194 also provides an upward force 314 (shown in FIG. 7) that directs the biasing end 140 away from the mounting end 138. The biasing end 140 includes the bend 144. The bend 144 is configured to engage the substrate 134 (shown in FIG. 4) of the electrical component 114 (shown in FIG. 4). The biasing end 140 is configured to move relative to the mounting end 138 to receive the substrate 134. The intermediate member 194 is configured to force the biasing end 140 upward to position the substrate 134. In other embodiments, the bend 144 is configured to engage the bottom surface if the transceiver shell 204 (shown in FIG. 4) of the electrical component 114 (shown in FIG. 4).

FIG. 4 illustrates the electrical component 114. In an exemplary embodiment, the electrical component 114 is a transceiver. The electrical component 114 may be a receiver, a transmitter, and/or any other suitable electrical component in alternative embodiments. The electrical component 114 is configured to couple to the electrical connector 100 (shown in FIGS. 1 and 2). The electrical component 114 electrically couples to the electrical connector 100 to direct electrical signals between the electrical component 114 and the substrate 112 (shown in FIG. 1).

The electrical component 114 includes a back end 200 and a mating end 202. A body 204 extends between the back end 200 and the mating end 202. The body 204 includes an upper shell 206 and a lower shell 208. The upper shell 206 and the lower shell 208 are coupled together to secure electrical devices (not shown) within the electrical component 114. The upper shell 206 and the lower shell 208 are secured together. The upper shell 206 and the lower shell 208 are removable to remove, replace, and/or reconfigure the electrical devices within the electrical component 114.

The substrate 134 extends through the body 204 of the electrical component 114. The substrate 134 may be a circuit board or the like. The substrate 134 includes a top surface 216 and a bottom surface 218. A mating end 214 of the substrate 134 extends from the mating end 202 of the electrical component 114. The mating end 214 of the substrate 134 includes the lower contact pads 190 positioned on the bottom surface 218 of the substrate 134. The lower contact pads 190 are configured to engage the lower contacts 184 (shown in FIG. 2) of the lower connector portion 118 (shown in FIGS. 1 and 2) of the electrical connector 100 (shown in FIGS. 1 and 2). In one embodiment, the lower contact pads 190 are configured to direct low speed signals to and from the electrical component 114. In one embodiment, the lower contact pads 190 are configured for DC signals.

A mating connector 220 is coupled to the mating end 214 of the substrate 134 at the mating end 202 of the electrical component 114. The mating connector 220 extends from the top surface 216 of the substrate 134. The mating connector 220 is electrically coupled to the substrate 134. The mating connector 220 includes an opening 221. The mating connector 220 includes the plug contacts 158 extending through the opening 221. The plug contacts 158 extend from the mating connector 220 toward the mating end 202 of the electrical component 114. The plug contacts 158 are configured to be received in the receptacles 156 (shown in FIG. 2) of the upper connector 116 (shown in FIGS. 1 and 2) of the electrical connector 100. The plug contacts 158 are offset from one another to match the configuration of the receptacles 156. The plug contacts 158 include upper plug contacts 222 positioned thereon. The upper plug contacts 222 are configured to engage the upper contacts 160 (shown in FIG. 2) of the upper connector portion 116. The upper plug contacts 222 direct electrical signals to and from the electrical component 114. In one embodiment, the upper plug contacts 222 direct high speed signals to and from the electrical component 114.

Figure 5:
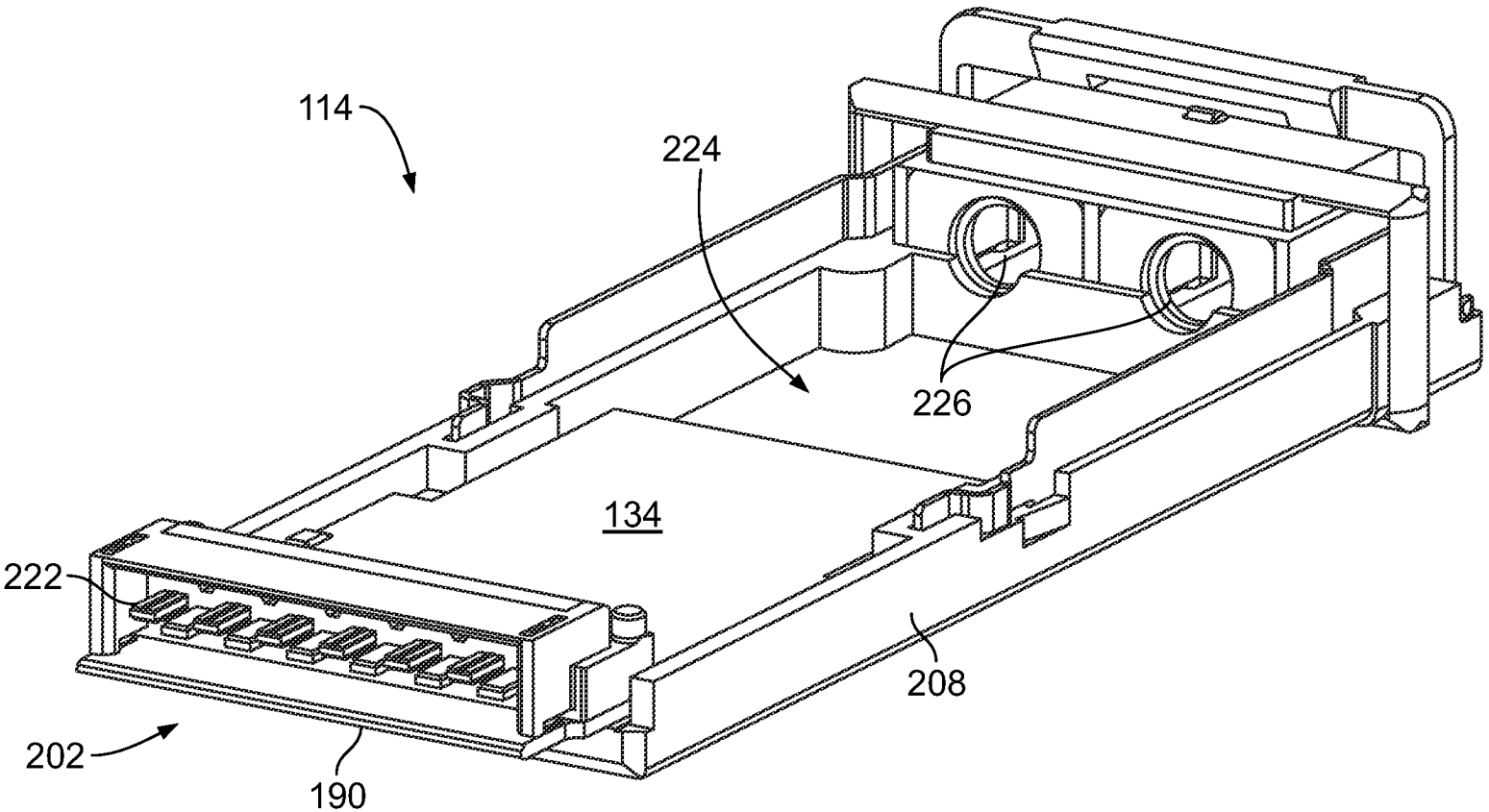
FIG. 5 is a top perspective view of the electrical component shown in FIG. 4 and with the upper shell removed.

FIG. 5 is a top perspective view the electrical component 114 with the upper shell 206 (shown in FIG. 4) removed. The electrical component 114 includes a cavity 224 defined by the lower shell 208 and the upper shell 206. The cavity 224 houses the electrical devices (not shown) of the electrical component 114. Openings 226 are formed in the back end 200 of the electrical component 114. The openings 226 may be configured to receive wires that couple the electrical devices of the electrical component 114 with a display on the back end 200 of the electrical component 114 and/or a peripheral device (not shown) joined to the electrical component 114.

The substrate 134 extends from the mating end 202 of the electrical component 114 into the cavity 224. In the illustrated embodiment, the substrate 134 extends partially into the cavity 224. Optionally, the substrate 134 may extend entirely through the cavity 224. The substrate 134 may have electrical devices coupled thereto. The substrate 134 electrically couples the electrical devices to the lower contacts 190 and the upper plug contacts 222 of the electrical component 114.

Figure 6:
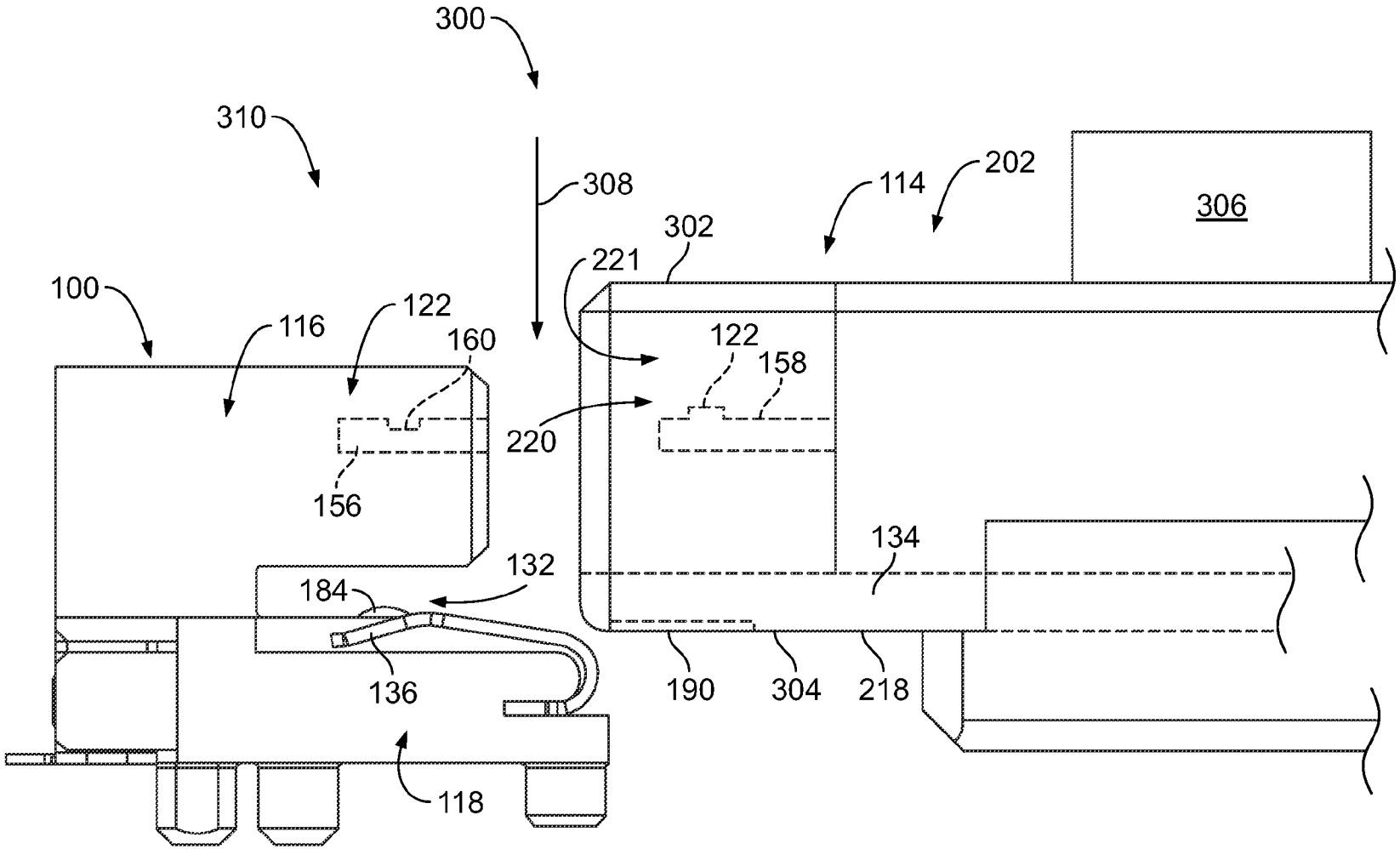
FIG. 6 is a side view of an electrical assembly formed in accordance with an embodiment and in an uncoupled position.

FIG. 6 illustrates an electrical assembly 300 formed in accordance with an embodiment. The electrical assembly 300 includes the electrical connector 100 and the electrical component 114. FIG. 6 illustrates the mating end 202 of the electrical component 114. FIG. 6 illustrates the electrical assembly 300 in an uncoupled position 310. The mating end 202 of the electrical component 114 includes a top surface 302 and a bottom surface 304. The substrate 134 is positioned along the bottom surface 304 of the mating end 202. The bottom surface 218 of the substrate 134 is flush with the bottom surface 304 of the mating end 202. The substrate 134 is aligned with the card slot 132 formed between the upper connector portion 116 and the lower connector portion 118. The lower contacts 190 of the electrical component 114 are aligned with the lower contacts 184 of the lower connector portion 118.

The flange 122 of the upper connector portion 116 is aligned with the opening 221 of the mating connector 220 of the electrical component 114. The flange 122 is configured to be received within the opening 221. The plugs 158 of the electrical component 114 are aligned with the receptacles 156 of the upper connector portion 116 so that the plugs 158 are received within the receptacles 156 when the flange 122 is positioned within the opening 221. The upper plug contacts 222 of the electrical component 114 are configured to engage the upper contacts 160 of the electrical connector 100 when the plugs 158 are inserted into the receptacles 156.

In an exemplary embodiment, a heat sink 306 is positioned on the electrical component 114. The heat sink 306 is configured to receive heat produced by the electrical component 114. The heat sink 306 creates a downward force 308 on the electrical component 114. For example, in one embodiment, the heat sink 306 may create a seven pound downward force 308 on the electrical component 114. The downward force 308 may misalign the plugs 158 and the receptacles 156. Such misalignment may result in faulty connections between the upper plug contacts 222 of the electrical component 114 and the upper contacts 160 of the electrical connector 100. A faulty connection may reduce the efficiency of the electrical assembly 300 and/or result in damage to the substrate 112 (shown in FIG. 1), the electrical connector 100, and/or the electrical component 114. The biasing member 136 is configured to counteract the downward force 308 to properly align the electrical connector 100 and the electrical component 114.

Figure 7:
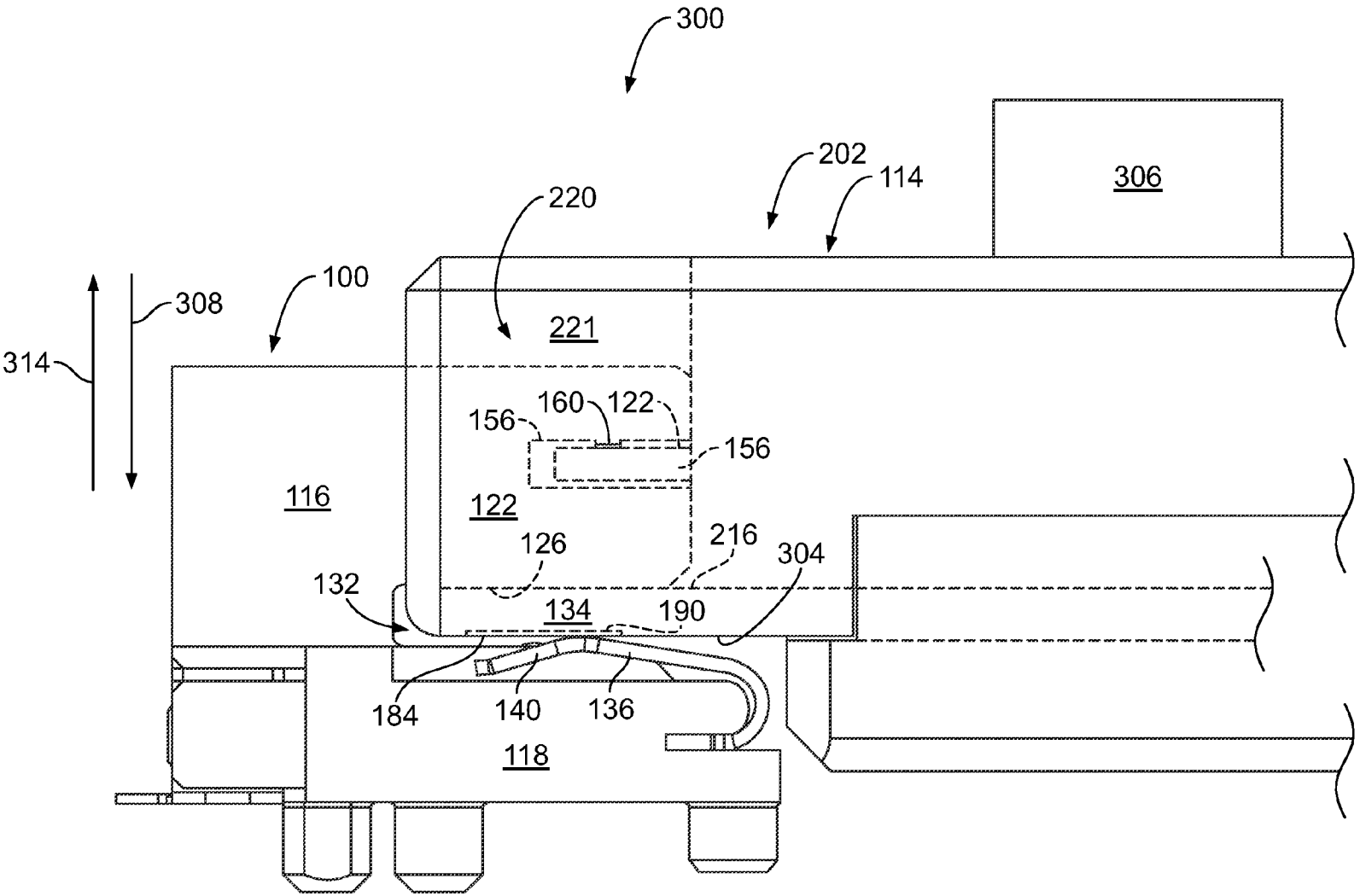
FIG. 7 is a side view of the electrical assembly shown in FIG. 6 and in a coupled position.

FIG. 7 illustrates the electrical assembly 300 in a coupled position 312. FIG. 7 illustrates the mating end 202 of the electrical component 114 coupled to the electrical connector 100. The biasing end 140 of the biasing member 136 is positioned against the bottom surface 304 of the mating end 202 of the electrical component 114. The biasing member 136 creates an upward force 314 on the electrical component 114. The upward force 314 is equal and opposite to the downward force 308 created by the heat sink 306. The upward force 314 aligns the electrical component 114 with respect to the electrical connector 100. The upward force 314 aligns the plugs 158 of the electrical component 114 with the receptacles 156 of the electrical connector 100 so that a proper connection is made.

The substrate 134 of the electrical component 114 is positioned within the card slot 132 so that the top surface 216 of the substrate 134 abuts the bottom surface 126 of the flange 122 of the upper connector portion 116. The lower contact pads 190 on the bottom surface 218 of the substrate 134 engage the lower contacts 184 of the lower connector portion 118 of the electrical connector 100.

The flange 122 of the upper connector portion 116 is positioned within the opening 221 of the mating connector 220. The plugs 158 of the electrical component 114 are positioned within the receptacles 156 of the electrical connector 100. The upper plug contacts 222 of the electrical component 114 engage the upper contacts 160 of the upper connector portion 116 of the electrical connector 100.

The biasing members 136 facilitate counteracting the downward force 308 created by the heat sink 306. It should be noted that the biasing member 136 is not limited to counteracting the downward force 308 created by the heat sink 306. In some embodiments, the biasing member 136 may counteract a downward force created by other components positioned on the electrical component 114. In other embodiments, the biasing member 136 may counteract a downward force created by the weight of the electrical component 114. The biasing member 136 enables proper alignment of the upper plug contacts 222 of the electrical component 114 and the upper contacts 160 of the upper connector portion 116 of the electrical connector 100. The biasing member 136 also enables proper alignment of the lower contact pads 190 of the electrical component 114 and the lower contacts 184 of the lower connector portion 118 of the electrical connector 100.

Figure 8:
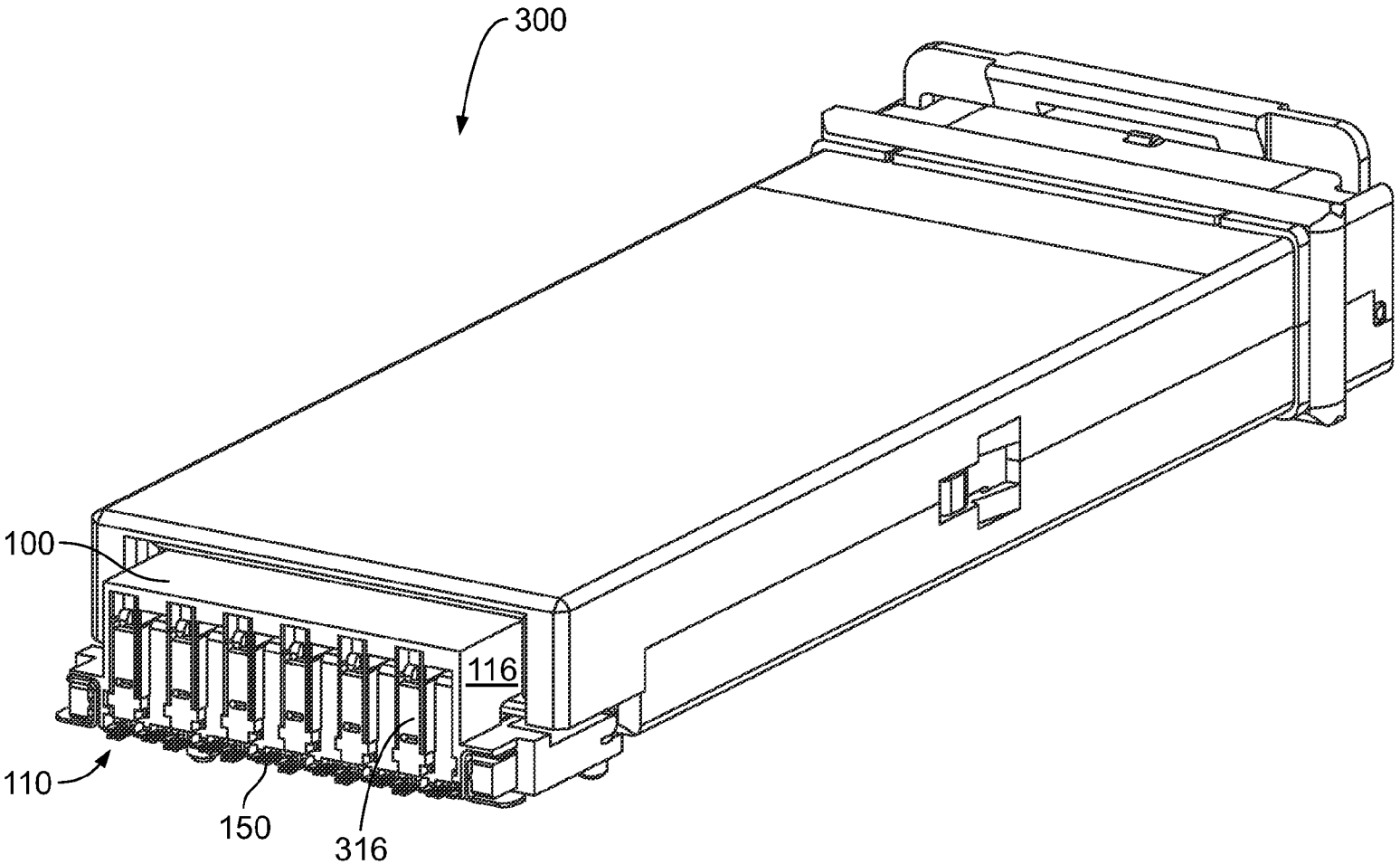
FIG. 8 is a top perspective view of the electrical assembly shown in FIG. 6 and in the coupled position.

FIG. 8 illustrates a top perspective view of the electrical assembly 300 in the coupled position 312. FIG. 8 illustrates a back view of the electrical connector 100. The back 110 of the electrical connector 100 includes leads 316 extending from the solder tails 150. The leads 316 couple the solder tails 150 to the upper contacts 160 (shown in FIG. 2) of the upper connector portion 116 of the electrical connector 100. In one embodiment, the leads 316 may be overmolded.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a housing having a top and a bottom;

an upper connector portion formed at the top of the housing, the upper connector portion having upper contacts;

a lower connector portion formed at the bottom of the housing, the lower connector portion having lower contacts;

a card slot formed between the upper connector portion and the lower connector portion, wherein the card slot is configured to receive a substrate having upper plug contacts and lower contact pads, the upper contacts of the upper connector portion configured to engage the upper plug contacts of the substrate, the lower contacts of the lower connector portion configured to engage the lower contact pads of the substrate; and a biasing member coupled to the lower connector portion, wherein the biasing member is configured to engage at least one of a bottom surface of the substrate or a bottom surface of a body housing the substrate to bias the substrate toward the upper connector portion to align the upper plug contacts of the substrate with the upper contacts of the upper connector portion;

wherein the lower connector portion comprises a contact portion extending between first and second end portions of the lower connector portion, the first and second end portions disposed on opposite sides of the contact portion, the lower contacts positioned within the contact portion, and wherein the biasing member extends upward from one of the first and second end portions of the lower connector portion, wherein the biasing member is positioned laterally outside of the contact portion of the lower connector portion.

2. The electrical connector of claim 1, wherein the upper contacts of the upper connector portion are configured to receive high speed signals from the substrate.

3. The electrical connector of claim 1, wherein the lower contacts of the lower connector portion are configured to receive low speed signals from the substrate.

4. The electrical connector of claim 1, wherein the biasing member extends from the lower connector portion toward the upper connector portion.

5. The electrical connector of claim 1, wherein the lower contacts of the lower connector portion extend into the card slot.

6. The electrical connector of claim 1, wherein the lower contacts of the lower connector portion extend toward the upper connector portion.

7. The electrical connector of claim 1, wherein the biasing member is not in electrical communication with the substrate.

8. An electrical connector comprising:

a housing having a first connector portion and a second connector portion positioned proximate to the first connector portion, the first connector portion configured to receive first contacts of a substrate and the second connector portion configured to receive second contacts of the substrate;

a card slot formed between the first connector portion and the second connector portion, the card slot configured to receive the substrate; and a biasing member coupled to the second connector portion and configured to engage at least one of a bottom surface of the substrate or a bottom surface of a body housing the substrate to bias the substrate toward the first connector portion to align the first contacts of the substrate with the first connector portion;

wherein the second connector portion comprises a contact portion extending between first and second end portions of the second connector portion, the first and second end portions disposed on opposite sides of the contact portion, the contact portion configured to receive the second contacts of the substrate, and wherein the biasing member extends from one of the first and second end portions of the second connector portion toward the first connector portion, wherein the biasing member is positioned laterally outside of the contact portion of the lower connector portion.

9. The electrical connector of claim 8, wherein the first connector portion is configured to receive high speed signals from the substrate.

10. The electrical connector of claim 8, wherein the second connector portion is configured to receive low speed signals from the substrate.

11. The electrical connector of claim 8, wherein the biasing member extends from the second connector portion toward the first connector portion.

12. The electrical connector of claim 8, wherein the second connector portion includes contacts that extend into the card slot.

13. The electrical connector of claim 8, wherein the biasing member is not in electrical communication with the substrate.

14. The electrical connector of claim 8, wherein the first connector portion includes receptacles configured to receive plugs extending from the substrate.

15. An electrical assembly comprising:

an electrical component having a substrate positioned therein, the substrate having upper plug contacts and lower contact pads, the electrical component including a body housing the substrate; and an electrical connector that couples to the electrical component, the electrical connector including:

an upper connector portion having upper contacts that engage the upper plug contacts of the substrate;

a lower connector portion coupled to the upper connector portion, the lower connector portion having lower contacts that engage the lower contact pads of the substrate;

a card slot formed between the upper connector portion and the lower connector portion, the card slot configured to receive the substrate of the electrical component; and a biasing member coupled to the lower connector portion, wherein the biasing member is configured to engage at least one of a bottom surface of the substrate or a bottom surface of the body housing the substrate to bias the substrate of the electrical component toward the upper connector portion to align the upper plug contacts of the substrate with the upper contacts of the upper connector portion;

wherein the lower connector portion comprises a contact portion extending between first and second end portions of the lower connector portion, the first and second end portions disposed an opposite sides of the contact portion, the lower contacts positioned within the contact portion, and wherein the biasing member extends ward from one of the first and second end portions of the lower connector portion, wherein the biasing member is positioned laterally outside of the contact portion of the lower connector portion.

16. The electrical assembly of claim 15, wherein the biasing member extends from the lower connector portion toward the upper connector portion.

17. The electrical assembly of claim 15, wherein the lower contacts of the lower connector portion extend into the card slot.

* * * * *